US011857846B2

(12) United States Patent
Soderquist et al.

(10) Patent No.: US 11,857,846 B2
(45) Date of Patent: Jan. 2, 2024

(54) BASEBALL LIKE TRAINING BALL

(71) Applicants: David G. Soderquist, Long Key, FL (US); Peter Wu, Taipei (TW)

(72) Inventors: David G. Soderquist, Long Key, FL (US); Peter Wu, Taipei (TW)

(73) Assignee: SWEETSPOT BASEBALL, LLC, Minnetonka, MN (US)

( * ) Notice: Subject to any disclaimer, the term of this patent is extended or adjusted under 35 U.S.C. 154(b) by 0 days.

(21) Appl. No.: 17/459,897

(22) Filed: Aug. 27, 2021

(65) Prior Publication Data

US 2022/0054896 A1 Feb. 24, 2022

Related U.S. Application Data

(62) Division of application No. 16/863,547, filed on Apr. 30, 2020, now Pat. No. 11,103,754.

(60) Provisional application No. 62/841,681, filed on May 1, 2019.

(51) Int. Cl.

| | |
|---|---|
| ***A63B 37/04*** | (2006.01) |
| ***A63B 37/12*** | (2006.01) |
| ***A63B 43/04*** | (2006.01) |
| *A63B 37/14* | (2006.01) |

(52) U.S. Cl.

CPC ..... *A63B 37/04* (2013.01); *A63B 37/12* (2013.01); *A63B 43/04* (2013.01); *A63B 37/14* (2013.01)

(58) Field of Classification Search

CPC ..... A63B 37/04; A63B 37/12; A63B 43/04; A63B 37/14; A63B 2102/18

See application file for complete search history.

(56) References Cited

U.S. PATENT DOCUMENTS

| | | | | |
|---|---|---|---|---|
| 932,911 A | | 8/1909 | Schibe | |
| 1,236,290 A | | 8/1917 | Griffin | |
| 1,684,557 A | * | 9/1928 | Saunders | A63B 39/00 273/DIG. 20 |
| 2,325,128 A | | 7/1943 | Grady | |
| 2,645,487 A | | 7/1953 | Hawes | |
| 3,788,297 A | | 1/1974 | Borst | |
| 4,248,423 A | | 2/1981 | Lotfy | |

(Continued)

FOREIGN PATENT DOCUMENTS

| | | |
|---|---|---|
| CA | 2287756 | 4/2001 |
| CA | 2402852 | 8/2001 |

(Continued)

OTHER PUBLICATIONS

Balls Shown on Web Page: https://web.archive.org/web/20150317035318/https://www.amazon.com/Franklin-Sports-Mini-Training-Balls/dp/B00SEJ14BG—capture date: Mar. 2015.

(Continued)

*Primary Examiner* — Steven B Wong
(74) *Attorney, Agent, or Firm* — R. John Bartz

(57) ABSTRACT

A lightweight spherical baseball like training ball has a hollow polyethylene plastic core adhered to a stitched white colored synthetic leather cover with a thin layer of adhesive. The lightweight ball has raised seams and measures in circumference similar to the ball circumference size mandated by Major League Baseball or softball rules whereby the ball is suitable for baseball and softball training and playing variations of the game of baseball or softball in confined areas.

7 Claims, 9 Drawing Sheets

(56) References Cited

U.S. PATENT DOCUMENTS

| | | | | | |
|---|---|---|---|---|---|
| 4,568,083 | A * | 2/1986 | Miller | B29D 99/0042 | 156/292 |
| 4,610,071 | A * | 9/1986 | Miller | A63B 37/00 | 29/458 |
| 4,653,752 | A * | 3/1987 | Miller | B29C 44/18 | 156/292 |
| 4,660,830 | A * | 4/1987 | Tomar | A63B 45/00 | 264/161 |
| 4,822,041 | A | 4/1989 | Molitor | | |
| 4,861,028 | A * | 8/1989 | Williams | A63B 37/06 | 273/DIG. 20 |
| 4,880,233 | A * | 11/1989 | Song | A63B 39/00 | 156/60 |
| 5,035,425 | A * | 7/1991 | Edwards | A63B 39/00 | 119/711 |
| 5,123,659 | A * | 6/1992 | Williams | C08L 23/025 | 473/601 |
| 5,588,648 | A * | 12/1996 | Stebbins | A63B 37/02 | 473/600 |
| 5,665,188 | A * | 9/1997 | McClure | A63B 45/00 | 156/331.7 |
| 5,700,211 | A * | 12/1997 | Mackie | A63B 43/00 | 473/613 |
| 5,711,729 | A * | 1/1998 | Chan | A63B 37/0098 | 473/600 |
| D407,127 | S | 3/1999 | Teifert | | |
| 5,984,813 | A * | 11/1999 | Cinnella | A63B 37/14 | 473/613 |
| 6,030,303 | A | 2/2000 | Wallace, Jr. | | |
| 6,458,052 | B1 | 10/2002 | Pitsenberger | | |
| 6,719,653 | B1 * | 4/2004 | Nesbitt | A63B 37/02 | 473/600 |
| 7,211,012 | B2 | 5/2007 | Laliberty | | |
| 8,771,114 | B2 * | 7/2014 | Markovich | A63B 37/06 | 473/600 |
| 9,205,310 | B1 * | 12/2015 | Hampton | A63B 39/00 | |
| 9,731,169 | B2 | 8/2017 | Sharp | | |
| 2003/0045384 | A1 | 3/2003 | Yang | | |
| 2005/0202911 | A1 | 9/2005 | Yang | | |
| 2008/0194362 | A1 | 8/2008 | Helmer | | |
| 2009/0137350 | A1 * | 5/2009 | Lenig | A63B 39/00 | 434/247 |
| 2010/0184542 | A1 | 7/2010 | Huang | | |
| 2012/0058845 | A1 | 3/2012 | Crowley | | |
| 2012/0071283 | A1 | 3/2012 | Ou | | |
| 2012/0142464 | A1 | 6/2012 | Smith | | |
| 2013/0095963 | A1 | 4/2013 | Smith | | |
| 2014/0256478 | A1 | 9/2014 | Gale | | |
| 2015/0126312 | A1 * | 5/2015 | Mayer, II | A63B 37/12 | 473/600 |
| 2015/0314182 | A1 * | 11/2015 | Kasdorf | A63B 37/12 | 473/451 |
| 2016/0067576 | A1 | 3/2016 | Repasi | | |
| 2017/0291075 | A1 | 10/2017 | McCafferty | | |
| 2018/0064999 | A1 | 3/2018 | Gump | | |

FOREIGN PATENT DOCUMENTS

| | | |
|---|---|---|
| CA | 2541471 | 10/2006 |
| DE | 368719 | 2/1923 |
| DE | 1946118 | 3/1970 |

OTHER PUBLICATIONS

Ball Shown on Web Page: https://web.archive.org/web/20170511052438/http://wilson.com/en-us/baseball/balls/college-high-school/a1015-sst-baseball-12-pack—capture date: May 2017.

Ball Shown on Web Page: https://web.archive.org/web/20060916012349/http://safetball.com/baseball.htm—Internet Archive capture date: Sep. 2006.

Balls Shown on Web Page: https://web.archive.org/web/20170401080206/http://safetball.com/—Internet Archive capture date: Apr. 2017.

* cited by examiner

BASEBALL LIKE TRAINING BALL

CROSS REFERENCE TO RELATED APPLICATION

This application is a division of U.S. application Ser. No. 16/863,547 filed Apr. 30, 2020. Application Ser. No. 16/863,547 claims the priority of U.S. Application Ser. No. 62/841,681 filed May 1, 2019.

FIELD OF THE INVENTION

The technology of the invention relates to baseball like balls or softball like balls used for training purposes and playing miniature versions of the game of baseball or softball.

BACKGROUND OF THE INVENTION

The baseball traces its origin to the game of the same name and is an object that has evolved over time. Standard baseballs have a solid cork center surrounded by rubber casings and layers of wool yarn, and covered with a leather cover sewn by hand with 108 double stitches or 216 individual stitches. Under current rules, a Major League Baseball ball weighs between 5 ounces and 5¼ ounces and is 9 inches to 9¼ inches in circumference. Standard softballs weigh between 6 and 7¼ ounces for 12-inch circumference softballs and 5⅞ and 6⅛ ounces for 11-inch circumference softballs. Baseballs typically consist of an inner core made of solid rubber-coated cork surrounded by layers of wool yarn and a winding of cotton or polyester yarn. The core is then coated in latex adhesive or rubber cement and covered with cowhide. Stitching is the done with red cotton thread to yield raised cotton stitches. The core of a softball is made of a synthetic mixture composed of either polyurethane or a combination of cork and rubber.

There are different types of baseballs used, namely, hardballs commonly used in Major League Baseball, traditional rubbers balls and soft compression balls used for batting practice and fielding training and indoor usage made from polyurethane material. Cricket balls are constructed with a cork center wrapped tightly with string and encased in leather with a raised seam of stitches. Baseballs used for children or practices have a solid center core with a low-quality cork of either solid rubber or a combination of rubber and ground cork. Typically, two layers of rubber surround the center core.

B. E. Shibe in U.S. Pat. No. 932,911 discloses a cork centered ball. Generally, a tighter wound, heavier, denser, solid-centered baseball will leave a bat faster and fly further than a baseball that is lightweight and has a hollow center.

Leather covers are the most popular choice to cover a baseball as they allow for better grip, improved performance and longer life. However, leather materials are cost prohibitive or unsuitable.

Miniature versions of the game of baseball have been played for decades such as stickball where elongated sticks are used to hit everything from rolled up socks to tennis balls. Wiffleball is a variation of the sport of baseball ideal for play in confined areas such as backyards, outdoor hockey rinks and cul-de-sac streets. The game is played using a lightweight, perforated plastic ball and a plastic bat. The ball most commonly used to play wiffleball is a ball having about the same size as a regulation baseball but is made of lightweight resilient plastic. One half of the ball is perforated with oblong holes whereby the ball can be easily curved when thrown by a pitcher. Games can be played in confined areas with minimal players and equipment at relatively low cost.

SUMMARY OF THE INVENTION

The baseball like training ball of the invention is a sphere formed by applying a thin layer of adhesive to the outer surface of a hollow core of polyethylene plastic material, covered with two figure-8 shaped strips of white synthetic leather, horsehide or cowhide, tightly stitched together. Preferably, the ball measures not less than 9 inches and no more that 9¼ inches in circumference similar to the ball size mandated by Major League Baseball rules but weighs substantially less than a standard baseball.

DESCRIPTION OF THE INVENTION

In the following detailed descriptions of the training ball, reference is made to the accompanying drawing that form a part hereof, and in which are shown, by way of illustration, specific embodiments in which the invention may be practiced. It is to be understood that other embodiments may be utilized and structure changes may be made or other method steps and sequence thereof may be used without departing from the scope of the present invention. The training ball is herein described as used in sporting, baseball and softball training environments. The ball can have uses in other environments when recreational activity in confined areas is desired.

Referring to FIGS. 1 to 5, there is shown a stitched leather baseball-like ball indicated generally at 10 useable for baseball training and playing modified baseball games in confined areas with minimal players and equipment. Ball 10 has an outer skin, shell or cover 11 of synthetic leather to provide a leather-like finish, appearance and feel. Cover 11 can also be made of cowhide leather and other artificial leathers as desired. Ball 10 has a diameter between 2⅜ and 3 inches and a circumference between 9 and 9¼ inches in conformance with current Major League Baseball rule requirements for ball size. The weight of ball 10 is substantially less than the Major League Baseball ball weight requirement of 5 ounces to 5¼ ounces. The relatively lightweight of ball 10 allows ball 10 to be easily thrown and curved, and to leave a bat with less velocity and fly shorter distances when hit, suitable for playing modified versions of the game of baseball, backyard baseball, and practicing or training for baseball. Preferably, ball 10 has a weight between 1¼ ounces and 1% ounces. Ball 10 can have other sizes and weights as desired, such as the size of an 11-inch or 12-inch regulation softball and a weight substantially less than the weight of a standard softball of 6¼ ounces to 7 ounces.

Figure 1:
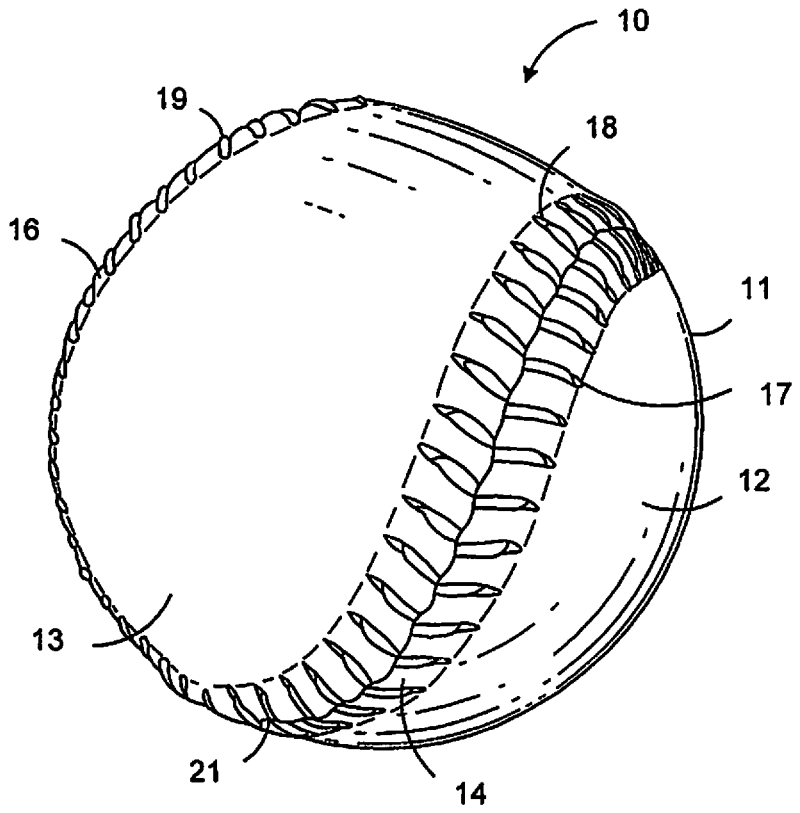
FIG. 1 is a perspective view of the training ball of the invention.
Figure 2:
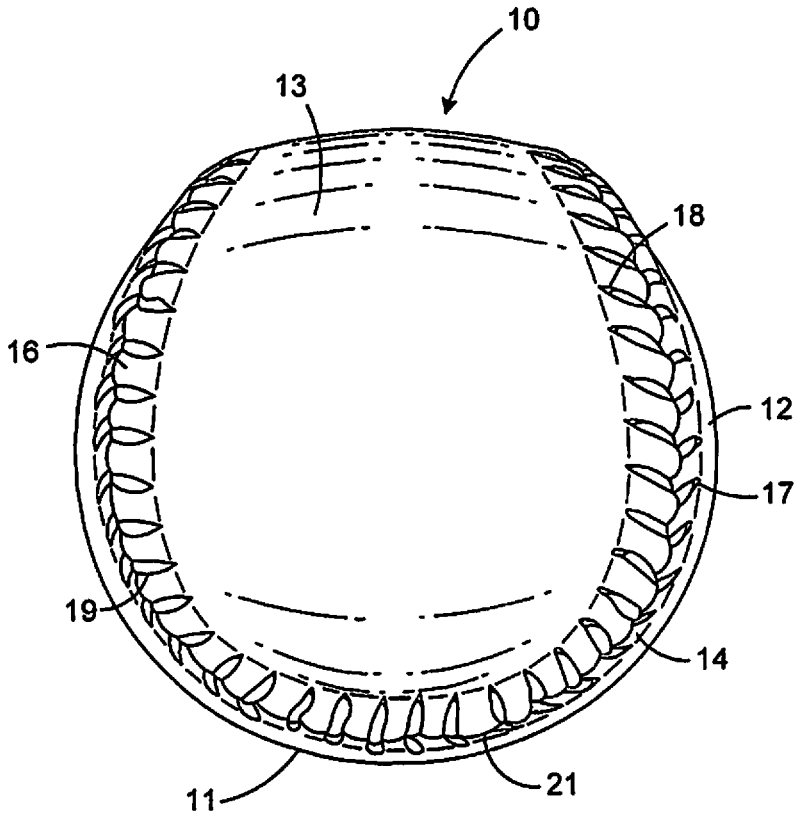
FIG. 2 is a front elevational view of the training ball of FIG. 1.
Figure 3:
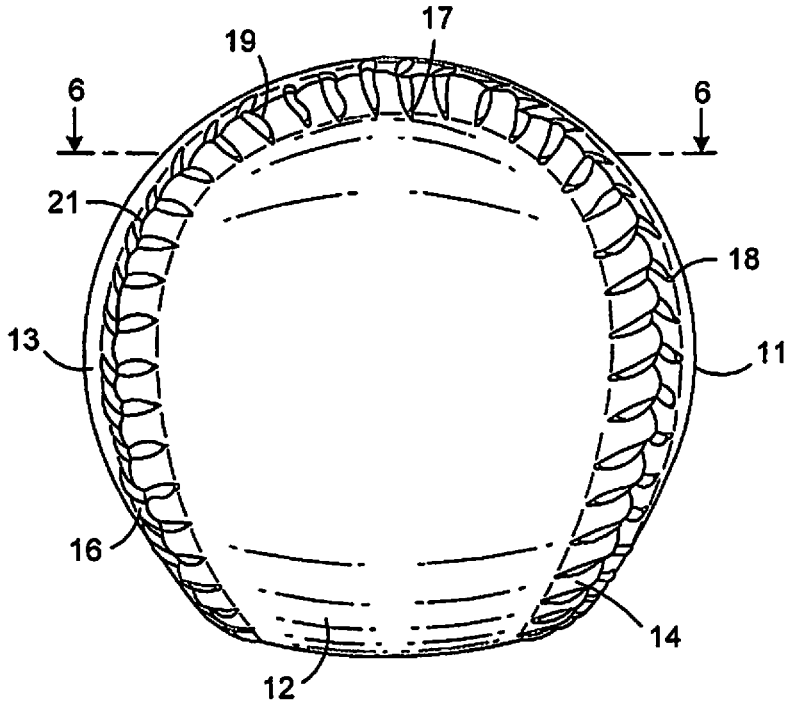
FIG. 3 is a side elevational view of the training ball of FIG. 1.
Figure 4:
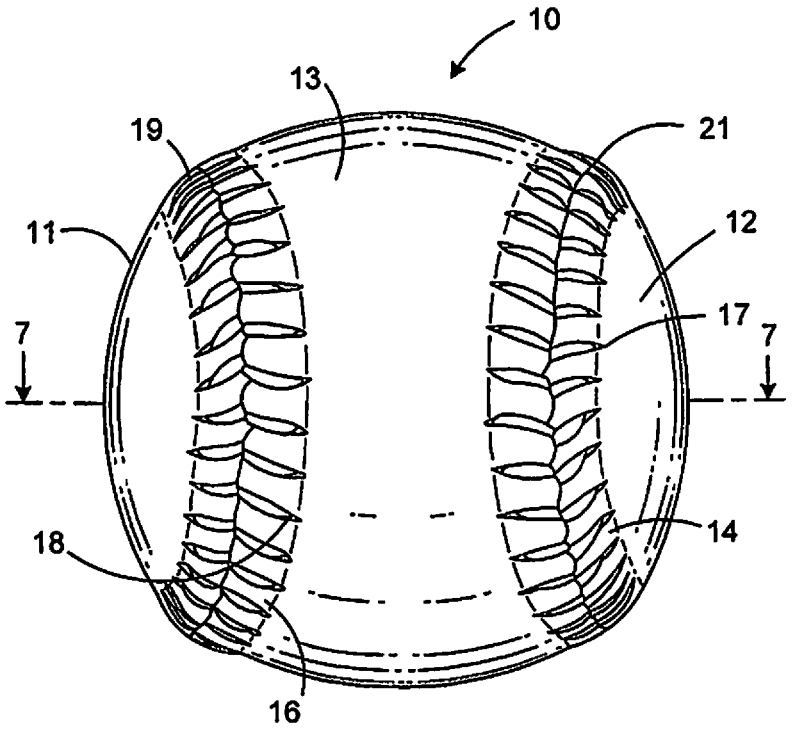
FIG. 4 is a top plan view of the training ball of FIG. 1.
Figure 5:
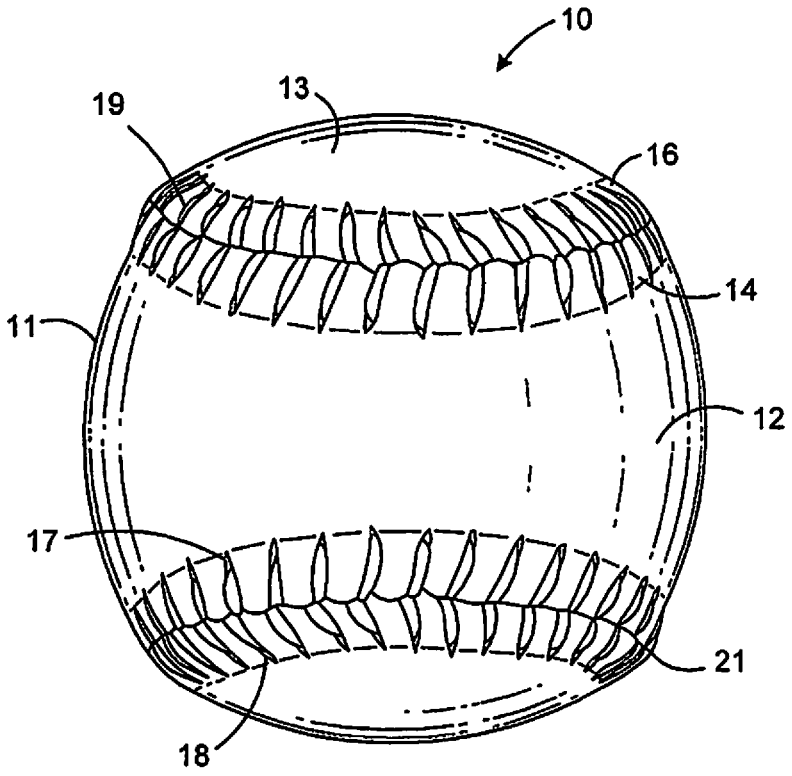
FIG. 5 is a bottom plan view of the training ball of FIG. 1.
Figure 6:
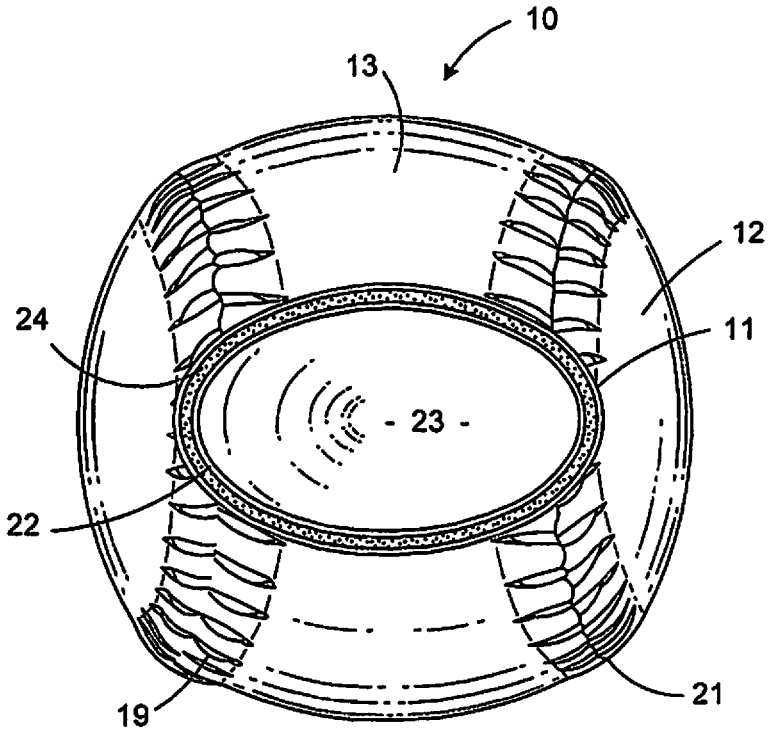
FIG. 6 is a sectional view taken along line 6-6 of FIG. 4.
Figure 7:
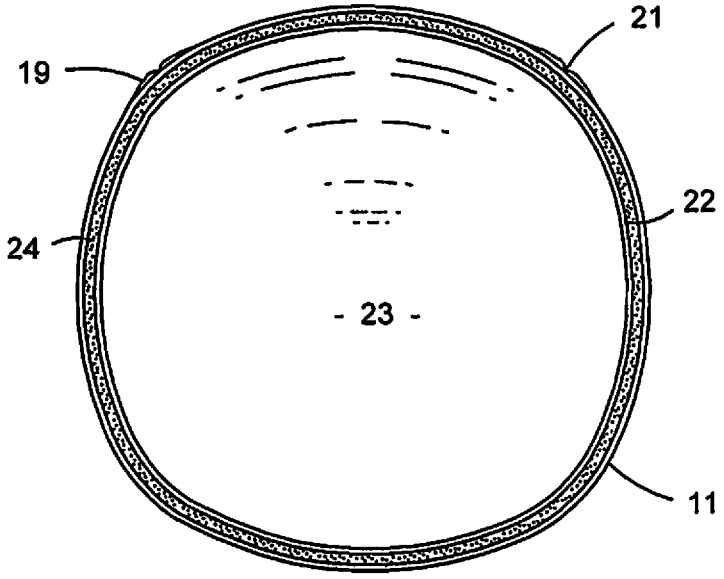
FIG. 7 is a sectional view taken along line 7-7 of FIG. 3.
Figure 8:
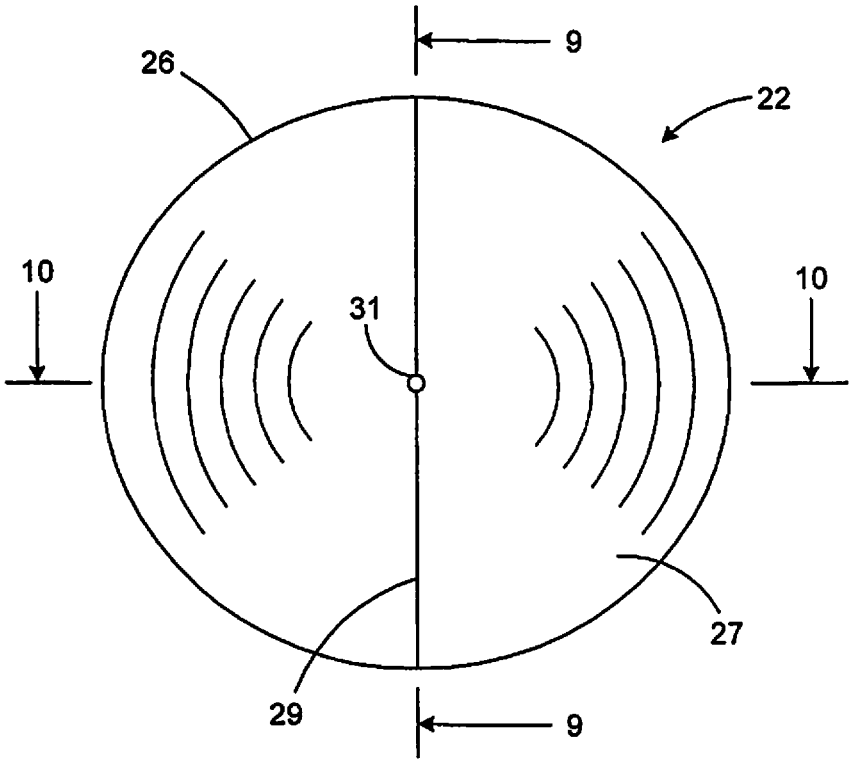
FIG. 8 is a front elevational view of the core of the training ball of FIG. 1.

Cover 11 is formed from two figure-8 shaped sections 12 and 13. Outer edges 14 and 16 of cover sections 12 and 13 have a plurality of holes 17 and 18 for receiving stitches 19. Ball 10 has a plurality of hand-stitched double stitches 19, such as ninety-six double stitches, in cover 11. Preferably, cover 11 is a synthetic polyurethane leather covering coated with white coloring and includes a textured outer finish to simulate a standard baseball. Cover 11 can also be made to have a covering coated with yellow coloring to simulate a standard softball. The synthetic polyurethane leather covering material of cover 11 increases durability of ball 10, and resists dirt and water allowing cover 11 to maintain its color and shape, and is not cost prohibitive as genuine leather covering materials tend to be. Figure-8 shaped sections 12 and 13 of cover 11 are hand-stitched together with stitches 19 to form raised seams 21. Stitches 19 are preferably red stitching made of 100% cotton. Other materials with various colors can be used to make stitches 19. For example, stitches 19 can be linen string stitches and can have black, blue or monochrome coloring to match the color of cover 11. Raised seams 21 are elevated off the surface of ball 10. As such, seams 21 grip air currents as ball 10 flys causing ball 10 to swerve to the right side, to the left side, downward, upward, or knuckle, or a combination thereof. Whether ball 10 moves sharply or gradually depends on the direction and speed ball 10 is thrown and how raised 21 seams have made to spin by a pitcher. The height of seams 21 also affects the type and amount of movement of ball 10 pitched by the pitcher to a batter. Seams 21 of ball 10 can be raised higher for use by beginner pitchers, recreational play and instructional purposes to facilitate exaggerated movement of ball 10 when pitched.

Figure 9:
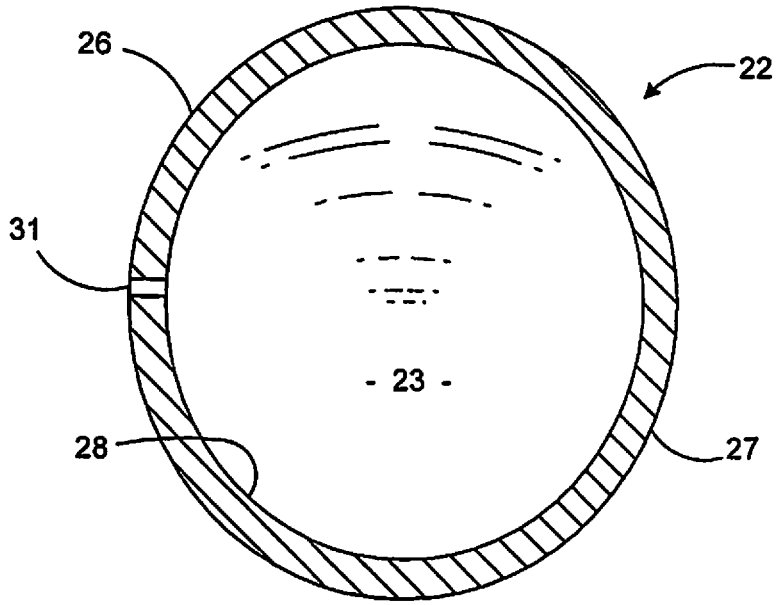
FIG. 9 is a sectional view taken along line 9-9 of FIG. 8.
Figure 10:
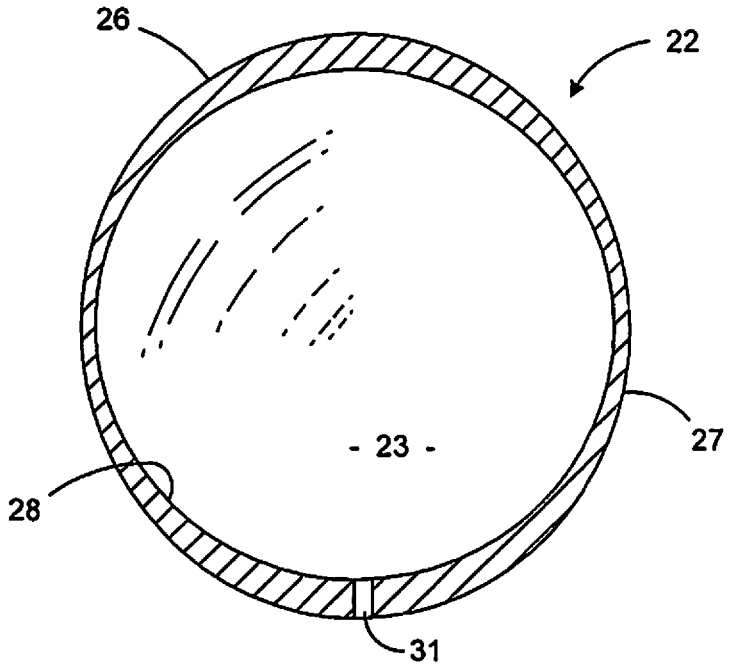
FIG. 10 is a sectional view taken along line 10-10 of FIG. 8.

As shown in FIGS. 6 to 10, ball 10 has a lightweight resilient plastic round inner core 22 having a hollow generally round center cavity 23. Core 22 is a polyethylene hollow spherical shaped member that absorbs almost no moisture. Core 22 has a spherical shell 26 adapted to absorb energy when it is compressed and deformed elastically and release compression energy upon unloading. Shell 26 has an outer spherical surface 27 having a middle seam 29. A hole 31 extends through seam 29 and is in communication with center cavity 23 to allow air to move into and out of center cavity 23 when shell 26 is compressed, such as when ball 10 is batted with a bat. Shell 26 has a rounded concave curved inner surface 28 opposite outer spherical surface 27 that surrounds center cavity 23. Core 22 is preferably formed by using a blow molding process whereby the thickness of shell 26 is varied and tapered, such as between 1 millimeter and 4 millimeters, to allow compression energy to be selectively released and thereby control the flight of ball 10 and the distance ball 10 travels when hit or thrown. As seen in FIGS. 9 and 10, the thickness of shell 26 tapers and is greater along seam 29 than the thickness of shell 26 outwardly from seam 29. Blow molding core 22 minimizes soft spots in shell 26 and ensures a uniform spherical outer surface of shell 26. Core 22 can also be made whereby shell 26 has a uniform thickness, such as by using an injection molding process to make shell 26 have a thickness that is uniform. Center cavity 23 of core 22 and the polyethylene plastic material of core shell 26 provides ball 10 with its relatively light weight and resiliency. Synthetic leather cover 11 is stitched onto core 22 to enclose core 22 whereby ball 10 has the look and feel similar to an official Major League Baseball ball or a standard softball. Preferably, a finished ball 10 weighs 1¼ to 1% ounces and measures not less than 9 inches and not more than 9¼ inches in circumference so as to simulate a standard baseball but having a noticeably lighter weight than a standard baseball. The hollow centered core 22 reduces the overall weight of ball 10 whereby ball 10 is relatively lightweight and easily thrown and curved, and when hit travels less distance. Ball 10 can have other weights and measures as desired. For example, ball 10 can made to measure in circumference substantially similar to the softball ball sizes mandated by United States Specialty Sport Association and other softball organizations and have weights substantially less than a standard softball.

A thin layer of glue or adhesive 24 is applied to and coats the outer spherical surface 27 of shell 26 before sewing on cover sections 12 and 13 together to enclose core 22. Adhesive 24 is a commercial grade adhesive that commercially adheres the stitched two figure-8 shaped sections 12 and 13 of cover 11 to the outer spherical surface 27 of shell 26. A thin layer of latex 25 similar to a balloon can also be placed or wrapped around core 22 whereby core 22 is covered with layer of latex 25 prior to stitching sections 12 and 13 together to enclose core 22.

In use, center cavity 23 and the varied thickness of shell 26 of core 22 impacts the performance of ball 10 causing ball 10 to travel less when hit. Raised seams 21 and the lightweight of ball 10 affects movement of ball 10 as seams 21 grip air currents causing ball 10 to swerve to the right side, to the left side, downward, upward, or knuckle, or a combination thereof as ball 10 travels from a pitcher to a batter. Ball 10 moves sharply or gradually depending on the direction and speed ball 10 is thrown and how raised seams 21 have been made to spin by the pitcher. The hand-stitched synthetic polyurethane leather covering material of cover 11 provides ball 10 with the look and feel of an official baseball, increases durability of ball 10, and resists dirt and water allowing cover 11 to maintain its color and shape.

The baseball like training balls illustrated and described include several embodiments of the invention. Variations and modifications of the ball and ball materials can be made by a person skilled in the art without departing from the invention.

The invention claimed is:

1. A ball for playing a modified game of baseball comprising:

an inner lightweight polyethylene spherical core, the inner lightweight polyethylene spherical core having a hollow round center cavity and an outer spherical polyethylene shell enclosing the hollow round center cavity, the outer spherical polyethylene shell having a rounded concave curved inner surface and an outer spherical surface opposite from the rounded concave curved inner surface, the rounded concave curved inner surface surrounding and encasing the hollow round center cavity, the outer spherical polyethylene shell having a middle seam and a hole extended through the middle seam, the hole being in communication with the hollow round center cavity to allow air to move into and out of the hollow round center cavity, the outer polyethylene spherical shell having a uniform thickness from the rounded concave curved inner surface to the outer spherical surface of between 1 millimeter and 3 millimeters to allow compression energy to be released from the inner lightweight polyethylene spherical core thereby controlling the flight of the ball, a synthetic polyurethane leather cover attached to the outer spherical surface of the outer spherical shell, the synthetic polyurethane leather cover surrounding and fully enclosing the inner lightweight polyethylene spherical core, the synthetic polyurethane leather cover having a first figure-8 shaped polyurethane leather cover portion and a second figure-8 shaped polyurethane leather cover portion attached to the first figure-8 shaped polyurethane leather cover portion, raised red colored double stitches attaching the first figure-8 shaped polyurethane leather cover portion to the second figure-8 shaped polyurethane leather cover portion thereby forming raised seams between the first figure-8 shaped polyurethane leather cover portion and the second figure-8 shaped polyurethane leather cover portion, a layer of adhesive coating the outer spherical surface of the outer spherical polyethylene shell and located between the outer spherical surface and the first figure-8 shaped polyurethane leather cover portion and the second figure-8 shaped polyurethane leather cover portion to adhere the first figure-8 shaped polyurethane leather cover portion and the second figure-8 shaped polyurethane leather cover portion to the outer polyethylene spherical core, and a layer of latex located between the first figure-8 shaped polyurethane leather cover portion and the second figure-8 shaped polyurethane leather cover portion and the outer spherical polyethylene shell, the first figure-8 shaped polyurethane leather cover portion and the second figure-8 shaped polyurethane leather cover portion each having a white coloring to simulate a standard baseball, the ball having a weight between 1¼ ounces and 1¾ ounces and a circumference between 9 inches and 9¼ to facilitate exaggerated swerving movements of the ball when thrown.

2. A ball for playing a modified game of baseball or softball comprising:

an inner lightweight round polyethylene core, the inner lightweight round polyethylene core having a hollow round center cavity and an outer polyethylene spherical shell surrounding and fully enclosing the hollow round center cavity, the outer polyethylene spherical shell having a uniform selected thickness between 1 millimeter and 3 millimeters to allow compression energy to be released from the inner lightweight round plastic core thereby controlling the flight of the ball, a synthetic leather cover surrounding the outer polyethylene spherical shell and fully enclosing the inner lightweight round polyethylene core, a layer of adhesive located between the synthetic leather cover and the outer polyethylene spherical shell to adhere the synthetic leather cover to the outer polyethylene spherical shell of the inner lightweight round plastic core, a layer of latex located between the synthetic leather cover and the outer polyethylene spherical shell, the synthetic leather cover having a first figure-8 shaped polyurethane synthetic leather cover portion and a second figure-8 shaped polyurethane synthetic leather cover portion attached to the first figure-8 shaped polyurethane synthetic leather portion, and raised red colored double stitches attaching the first figure-8 shaped polyurethane synthetic leather cover portion to the second figure-8 shaped polyurethane synthetic leather cover portion, the first figure-8 shaped polyurethane synthetic leather cover portion and the second figure-8 shaped synthetic cover portion each having a selected white or yellow coloring whereby the ball simulates a standard baseball or a standard softball, the ball having a selected weight between 1¼ ounces and 1¾ ounces or between 2¼ ounces and 2¾ ounces to facilitate exaggerated swerving movements of the ball when thrown.

3. The ball of claim 2 wherein:

the inner inner lightweight round polyethylene core is a polyethylene hollow spherical shaped member, the polyethylene hollow spherical shaped member having a middle seam, and a hole extending through the middle seam, the hole being in communication with the hollow round center cavity to allow air to move into and out of the hollow round center cavity.

4. A method of making a ball for playing a modified game of baseball or softball comprising:

injection molding an inner lightweight round polyethylene core, the inner lightweight round polyethylene core having an outer polyethylene plastic spherical shell surrounding and encasing a hollow round center cavity, the outer polyethylene plastic spherical shell having a uniform selected thickness between 1 millimeter and 3 millimeters to allow compression energy to be released from the inner lightweight round polyethylene core thereby controlling the flight of the ball, coating the outer spherical surface of the outer polyethylene plastic spherical shell with a layer of adhesive, hand stitching a first figure-8 shaped synthetic leather cover section to a second figure-8 shaped synthetic leather cover section and onto the outer polyethylene plastic spherical shell with red colored double stitches thereby forming raised seams between the first figure-8 shaped synthetic leather cover section and the second figure-8 shaped synthetic leather cover section, locating a layer of latex between the outer polyethylene plastic spherical shell and the first figure-8 shaped synthetic leather cover section and the second figure-8 shaped synthetic leather cover section, adhering the first figure-8 shaped synthetic leather cover section and the second figure-8 shaped synthetic cover section to the outer spherical surface of the outer polyethylene plastic spherical shell with the layer of adhesive, coloring the first figure-8 shaped synthetic leather cover section and the second figure-8 shaped synthetic cover section each with a selected white or yellow coloring and texturing the first figure-8 shaped synthetic leather cover section and the second figure-8 shaped synthetic cover section each with a selected texture to simulate a standard baseball or a standard softball, providing the ball with a selected weight between ounces or 1¼ ounces and 1¾ ounces or between 2¼ ounces and 2¾ ouncesto facilitate exaggerated swerving movements of the ball when thrown.

5. The method of claim 4 including:

providing the outer polyethylene plastic spherical shell with a middle seam, and extending a hole through the middle seam in communication with the hollow round center cavity to allow air to move into and out of the hollow round center cavity.

6. The method of claim 4 wherein:

the selected weight of the ball is between 1¼ ounces and 1¾ ounces, and the ball having a circumference between 9 inches and 9¼ inches.

7. The method of claim 4 wherein:

the selected weight of the ball is between 2¼ ounces and 2¾ ounces, and the ball having a circumference between 10⅞ inches and 11⅛ inches.

* * * * *